US005422171A

United States Patent [19]

Nabeshima et al.

[11] Patent Number: 5,422,171

[45] Date of Patent: Jun. 6, 1995

[54] COMPOSITE CRIMPED YARN AND WOVEN FABRIC

[75] Inventors: Keitaro Nabeshima, Osaka; Minoru Wakabayashi; Toshiaki Miura, both of Aichi, all of Japan

[73] Assignees: Toray Industries, Inc., Tokyo; Toray Textiles, Inc., Osaka, both of Japan

[21] Appl. No.: 192,743

[22] Filed: Feb. 7, 1994

Related U.S. Application Data

[62] Division of Ser. No. 951,998, Sep. 24, 1992, Pat. No. 5,307,614.

[30] Foreign Application Priority Data

Sep. 26, 1991 [JP] Japan ..... 3-246393
Mar. 2, 1992 [JP] Japan ..... 4-44946

[51] Int. Cl.[6] ..... D03D 3/00

[52] U.S. Cl. ..... 428/229; 428/225; 139/420 A; 139/426 R

[58] Field of Search ..... 139/420 A, 426 R; 428/225, 229; 57/284, 235

[56] References Cited

U.S. PATENT DOCUMENTS 3,023,483 3/1962 Steiner ..... 57/206
4,365,466 12/1982 Horiuchi et al. ..... 57/207
4,541,196 6/1984 Iohara et al. ..... 57/207

FOREIGN PATENT DOCUMENTS 61528 3/1989 Japan .
210076 8/1990 Japan .

*Primary Examiner*—James J. Bell
*Attorney, Agent, or Firm*—Nikaido, Marmelstein Murray & Oram

[57] ABSTRACT

A composite crimped yarn comprising: at least two kinds of multifilament yarns, one of them being comprised of a crimped conjugate multifilament yarn comprising two kinds of polyester polymers different from each other in the heat shrinkability and positioned as a major component of the inner layer of the composite crimped yarn, the other of them being comprised of a crimped multifilament yarn of a single synthetic polymer and positioned as a major component in the outer layer of the composite crimped yarn, In the above, the length of the crimped multifilament yarn is 5 to 35% larger than that of the crimped conjugate multifilament yarn, part of the crimped multifilament yarn being migrated to the crimped conjugate multifilament yarn disposed in the inner layer and part of the crimped conjugate multifilament yarn being migrated to the crimped multifilament yarn disposed in the outer layer.

10 Claims, 1 Drawing Sheet

COMPOSITE CRIMPED YARN AND WOVEN FABRIC

This is a division of application Ser. No. 07/951,998 filed Sep. 24, 1992, U.S. Pat. No. 5,307,614.

BACKGROUND OF THE INVENTION

The present invention relates to a composite crimped yarn comprising at least two kinds of multifilament yarns and a woven fabric prepared therefrom, and more particularly, to a composite crimped yarn which can be woven into a fabric having a suitable stretching property capable of improving the sewability while enjoying puffiness and koshi (stiffness) and hari (anti-drape stiffness) similar to those of a woven wool fabric and a drapability inherent in the polyester filament yarn, and a woven fabric prepared therefrom.

As compared with other synthetic fibers, a polyester filament yarn is featured by a less liability to creasing and an excellent adaptability to pleating. An effort has been made to apply a polyester filament yarn having the above-described properties to the fields of suits, bottoms (for example trousers and skirts), etc., where moderately thick or thick wool woven fabrics are extensively used. For the time being, the intention of preparing a polyester woven fabric having a texture close to that of the wool woven fabric, that is, puffiness and koshi and hari, has to be attained by the "woolie" processing method wherein polyester filament yarns are subjected to false twisting and a method wherein two kinds of polyester filament yarns different from each other in the properties are subjected to composite false twisting. However, the development has been further advanced and an attempt has been made not only to bring the texture of the woven polyester fabric close to that of the woven wool fabric but also to impart a drapability inherent in the polyester filament which the woven wool fabric cannot exhibit. As a result, a technique as described in Japanese patent publication No. 61-19733 has been developed.

This method for imparting not only puffiness and koshi and hari similar to those of the woven wool fabric but also a drapability inherent in the polyester filament comprises doubling two kinds of undrawn yarns or partially drawn yarns of polyester filaments different from each other in the elongation, subjecting the doubled yarns to composite false twisting and forming a woven fabric from the resultant composite crimped yarn, wherein the composite crimped yarn is previously subjected to additional twisting. In the twisted composite crimped yarn, when the number of twists (additional twisting) is increased, a core-sheath structure having a two layer structure wherein a multifilament yarn as the outer layer is randomly wound round another multifilament yarn as the inner layer, and curved monofilaments having a size of several microns to several tens of microns are allowed to exist on the outer surface. Therefore, when a fabric is woven out of this composite crimbed yarn, not only puffiness is imparted to the woven fabric but also drapability is imparted through an increase in the density of the multifilament yarn derived from additional twisting.

Although the composite crimped yarn comprising the conventional core-sheath structure imparts puffiness and drapability to the woven fabric, the development of crimping of the multifilament yarn in the core portion is restrained by the twisting applied for the purpose of imparting the drapability, so that the stretching property lowers to a great extent unfavorably. Therefore, when a moderately thick or thick fabric is woven out of the composite crimped yarn, the stretching property becomes so insufficient that the tension of sewing yarn cannot be absorbed during sewing. This gives rise to the occurrence of a crease called "puckering" at the seam, which worsens the tailorability.

SUMMARY OF THE INVENTION

An object of the present invention is to provide a composite crimped yarn which can be woven into a fabric having a suitable stretching property capable of improving the sewability while enjoying puffiness and koshi and hari similar to those of a woven wool fabric and a drapability inherent in the polyester filament yarn.

Another object of the present invention is to provide a woven fabric which has puffiness and koshi and hari similar to those of a woven wool fabric and, at the same time, a drapability inherent in a polyester filament yarn and further suitable stretching property and an excellent sew-ability.

In order to attain the above-described objects, the composite crimped yarn according to the present invention comprises at least two kinds of multifilament yarns, one of them being comprised of a crimped conjugate multifilament yarn comprising two kinds of polyester polymers conjugated to each other and different from each other in the heat shrink-ability and positioned as a major component of the inner layer of the composite crimped yarn, the other of them being comprised of a crimped multifilament yarn of a single synthetic polymer and positioned as a major component in the outer layer of the composite crimped yarn. In the above-described construction of the composite crimped yarn, when the composite crimped yarn is twisted and fabric is woven out of the twisted composite crimped yarn, the resultant woven fabric has a hand such as puffiness and koshi and hari and, at the same time, a drapability which is a texture inherent in the polyester filament yarn.

Further, in the composite crimped yarn of the present invention, the length of the crimped multifilament yarn is adjusted to be 5 to 35% larger than that of the crimped conjugate multifilament yarn, and part of the crimped multifilament yarn is migrated to the crimped conjugate multifilament yarn constituting the inner layer. Further, part of the above-described conjugate multifilament yarn is migrated to the crimped multifilament yarn constituting the outer layer. The migration of part of the crimped multifilament yarn constituting the outer layer to the crimped conjugate multifilament yarn constituting the inner layer causes the three-dimensional crimp of the crimped conjugate multifilament yarn to have phases shifted from one constituent filament, so that even when a restraint is applied by twisting, the crimping force of the conjugate multifilament yarn overcomes the restraint of the twisting, thereby exhibiting the stretching property.

Therefore, in the composite crimped yarn according to the present invention, a suitable stretching property is exhibited even when a number of twists are applied for the purpose of imparting the drapability. Specifically, the composite crimped yarn exhibits a stretching property of 18 or more in terms of the crimped rigidity, CR, and 8 or more in terms of the textured rigidity, TR, when a twisting having a twist coefficient, $\alpha$, in the range of from 5,700 to 20,200 has been applied. Preferably, the crimped rigidity, CR, and the textured rigidity, TR, are 18 to 50% or, more preferably, 18 to 35% and 8 to 25% or, more preferably, 8 to 20%, respectively.

As described above, the woven fabric according to the present invention can be prepared by conducting weaving through the use of a twisted composite crimped yarn as a warp yarn or a weft yarn or both of a warp yarn and a weft yarn, and subjecting the resultant woven fabric to a treatment for developing a crimp in the step of dyeing. In the twist of the composite crimped yarn within the resultant woven fabric, the twist coefficient, $\alpha$, is 7,100 to 21,300, and the stretching property of the stretchability in the direction of the above-described warp yarn and/or weft yarn is 3 to 25%. Since the composite crimped yarn within the woven fabric shrinks when subjected to a crimp developing treatment, the twist coefficient, $\alpha$, is changed from the value of 6,700 to 20,200 applied in the additional twisting before processing to a value of 7,100 to 21,300.

Thus, since the stretching property of the woven fabric is 3 to 25% in terms of stretchability, the tension of the sewing yarn is absorbed by virtue of the stretching property during sewing, no puckering (creasing) occurs, which contributes to an improvement in the tailorability of the sewing.

DETAILED DESCRIPTION OF THE INVENTION

Several parameters are used for specifying the present invention. These parameters will now be defined as follows.

The difference, ΔL, in the yarn length between the crimped multifilament yarn and the crimped conjugate multifilament yarn is a value measured by the following method.

Specifically, a load of 0.1 time that of the apparent fineness (D), 0.1×D (g), is applied to a sample composite crimped yarn, and a sample having a length of about 5 cm is chosen when the degree of interlacing among the filaments is ordinary and a sample having a length of about 3 cm is chosen when the degree of interlacing among the filament is high. In this case, when the sample is in a twisted state, it is not pulled and is brought to an untwisted state. Then, the filaments are untangled on a velvet plate with a disintegrating needle and a pincette having a thin tip so that the sample is not twisted. Glycerin is thinly applied to a length measuring glass plate having a test length scale. Tension is applied to the filament in such a manner that the crimp is spontaneously elongated while the filament per se is not elongated. In this state, the scale is read. The yarn elongation difference, ΔL, is calculated by the following equation (1):

$$\Delta L = \frac{L_2 - L_1}{L_1} \times 100\,(\%) \tag{1}$$

wherein $L_1$ is the length of the measured crimped conjugate multifilament yarn, and $L_2$ is that of the crimped multi-filament yarn.

The twist coefficient, if, is a value defined by the following formula (2):

$$\alpha = T\sqrt{D} \tag{2}$$

wherein T is the number of twists (turns/meter), and D is the fineness (denier) of the composite crimped yarn.

The crimped rigidity, CR, is a value measured by the method specified in JIS L 1090 (Testing methods for synthetic filament stretch yarns).

The textured rigidity, TR, is a value measured by the following method.

Specifically, the composite crimped yarn sample is wound five times round a hank, and measurement is conducted on the length, $L_4$, which is a length when a dry heating treatment is conducted at 150±2° C. for 5 minutes in such a state that a load of 0.02 time of the apparent fineness (D), 0.02×D (g), is applied to the composite crimped yarn. Then, measurement is conducted on the length, $L_3$, which is a length when a load of 0.1 time of the apparent fineness (D), 0.1×D (g), is applied to the composite crimped yarn. The textured rigidity, TR, is calculated from both lengths, $L_3$ and $L_4$, according to the following equation:

$$TR\,(\%) = \frac{L_3 - L_4}{L_4} \times 100 \tag{3}$$

The stretchability, ST, is a value measured under a load of 1.8 kg according to the Method A (the constant-rate stretching method) specified in JIS L 1096 (Measuring method for stretchability of stretch fabric).

Figure 1:
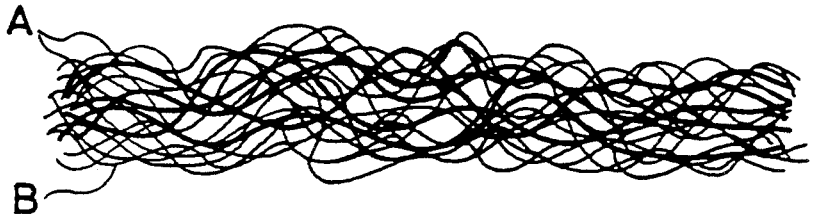
FIG. 1 is a model diagram showing a composite crimped yarn before twisting according to an embodiment of the present invention.

As shown in the model of FIG. 1, in the composite crimped yarn according to the present invention, a crimped conjugate multifilament yarn A comprising two kinds of polyester polymers different from each other in heat shrinking properties is mainly disposed as an inner layer of the composite crimped yarn A, and a randomly crimped multifilament yarn B comprising a single synthetic polymer is mainly disposed as an outer layer of the composite crimped yarn. It is a matter of course that the two kinds of crimped conjugate multifilament yarn A and/or two kinds of crimped multifilament yarn B are allowed to exist in the form of a mixture.

The additional feature resides in that firstly the crimped multifilament yarn B is longer than the crimped conjugate multifilament yarn A with a yarn length difference, ΔL, of 5 to 35%, and secondly the crimped conjugate multifilament yarn A constituting the inner layer and the crimped multifilament yarn B constituting the outer layer are not clearly separated from each other to form a two-layer structure as opposed to the conventional core-sheath structure. Specifically, part of the crimped multifilament yarn B as the outer layer is migrated to the crimped conjugate multifilament yarn A as the major component of the inner layer, and par t of the crimped conjugate multifilament yarn A is migrated to the crimped multifilament yarn B as the major component of the outer layer.

Figure 2:
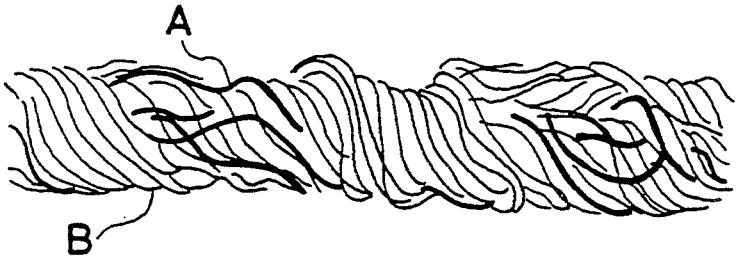
FIG. 2 is a model diagram showing a composite crimped yarn after twisting (additional twisting) according to an embodiment of the present invention.

The composite crimped yarn having the above-described construction is twisted before weaving into a fabric, so that as shown in FIG. 2 the multifilament yarn B as the outer layer is wound round the conjugate multifilament yarn A as the inner layer. That is, the twisting is applied to such an extent that the twist coefficient, $\alpha$, is in the range of from 6,700 to 20,200. When the composite crimped yarn thus twisted is woven, the resultant woven fabric has puffiness and koshi and hari similar to those of a woven wool fabric and, at the same time, a drapability inherent in the polyester filament yarn.

In this case, in the conventional core-sheath crimped yarn, since the development of crimp of the conjugate multifilament yarn in the core portion is suppressed by the restraint of twist derived from the above-described twisting, no stretching property can be exhibited. In the composite crimped yarn according to the present invention, however, even in the case of the above-described twisting, since part of the multifilament yarn B is migrated to the conjugate multifilament yarn A without a significant binding of three-dimensional crimps and the crimp partly appears on the surface of the composite crimped yarn. For this reason, the development of crimp of the conjugate multifilament yarn A can overcome the restraint of twist, and even when the number of twists is increased, the lowering in the crimped rigidity, CR, and textured rigidity, TR, is smaller than those developed in a non-twisting state, so that an excellent stretching property can be exhibited.

Further, since the crimped multifilament yarn B is longer than the crimped conjugate multifilament yarn A with a yarn length difference, $\Delta L$, of 5 to 35%, the above-described action of the crimp development of the conjugate multifilament yarn A is effectively exhibited. When the yarn length difference, $\Delta L$, is smaller than 5%, the development of crimp of the conjugate multifilament yarn A as the inner layer becomes poor due to the restraint of the twist. On the other hand, when the yarn length difference exceeds 35%, the tension derived from the twisting during twisting operation is increased, which brings about an excessive increase in the restraint of the multifilament yarn A as the outer layer. This causes the crimp developing power of the conjugate multifilament yarn A to become so low that the stretching property becomes poor. The resultant composite crimped yarn according to the present invention exhibits a stretching property of 18 to 50% in terms of the crimped rigidity, CR, and 8 to 25% in terms of the textured rigidity, TR, in a state twisted to such an extent that the twist coefficient, $\alpha$, is in the range of from 6,700 to 20,200.

The conjugate crimped yarn having the above-described properties according to the present invention can be woven into a fabric having puffiness and drapability and, at the same time, an excellent stretching property by previously applying a twist in the range of from 6,700 to 20,200 in terms of the twist coefficient, $\alpha$, conducting weaving through the use of the twisted yarn as a warp yarn or a weft yarn or both of a warp yarn and a weft yarn and subjecting the resultant woven fabric to a crimp development treatment in the step of dyeing. It is also possible to further improve the hand of the woven fabric by treating the woven fabric with an alkali such as caustic soda in the step of dyeing to partly dissolve the surface of the polyester polymer fiber.

The twist of the composite crimped yarn within the woven fabric after the step of dyeing is changed from a twist coefficient, $\alpha$, in the range of from 6,700 to 20,200 to a twist coefficient, $\alpha$, in the range of from 7,100 to 21,300, and the stretchability, ST, of the woven fabric is 3 to 25% in the direction of the warp or weft or in the direction of both the warp and weft wherein use is made of the above-described composite crimped yarn. The reason for the change in the twist coefficient, $\alpha$, as described above is that the composite crimped yarn shrinks in the step of dyeing in the weaving. When the twist coefficient and the stretchability are each outside the above-described range, the woven fabric is poor in the drapability and, at the same time, has a lowered quality and the comfortableness in wearing lowers. When the stretchability of the woven fabric is less than 3%, puckering occurs at the seam during sewing on a sewing machine, so that the tailorability becomes poor. On the other hand, when the stretchability of the woven fabric exceeds 25%, the comfortability in wearing becomes low.

In order for the woven fabric to exhibit the above-described stretchability, it is necessary that the composite crimped yarn used in the woven fabric have a stretching property even in the presence of twist derived from twisting and the woven fabric undergoes work shrinking during dyeing in such a state that the warp crosses the weft. The work shrinking of the woven fabric is not possible without the development of the crimp of the composite crimped yarn. In order for the woven fabric to have a stretchability of 3 to 25%, it is preferred that the work shrinkage within the woven fabric be 5% or more.

In the composite crimped yarn constituting the above-described woven fabric according to the present invention, the crimped conjugate multifilament yarn constituting the major component of the inner layer comprises a polyester polymer. In this case, the crimped multifilament yarn of a single polymer constituting the major component of the outer layer preferably comprises a polyester polymer although use may be made of other synthetic polymer. For example, it is also possible to use nylon, a cation-dyeable polyester having a different dyeability, etc. Further, it is also possible to use an easily dividable very fine filament yarn comprising a combination of nylon with a different synthetic polymer such as a polyester.

For the above-described crimped multifilament yarn constituting the major component of the outer layer, thick and thin yarn is preferably used for a raw material before false twisting. Further, when the thick and thin yarn comprises polyester, it is preferable to use a yarn having a birefringence of $15\times10^{-3}\sim80\times10^{-3}$, preferably $30\times10^{-3}\sim80\times10^{-3}$, more preferably $40\times10^{-3}\sim80\times10^{-3}$ in the thick portion and a birefringence of $90\times10^{-3}\sim200\times10^{-3}$, preferably $90\times10^{-3}\sim150\times10^{-3}$, more preferably $90\times10^{-3}\sim120\times10^{-3}$ in the thin portion. Processing the thick and thin yarn having the above birefringences to a false twisting method, the thick portion of the yarn is drawn to a longer extent than the thin portion, whereby migration of part of the crimped multifilament yarn to the inner layer of the crimped conjugate multifilament yarn is effectively enhanced and as a result of this, the stretchability of the yarn is more elevated.

The conjugate multifilament yarn disposed as the major component of the inner layer preferably accounts for 30 to 70% by weight of the whole composite yarn.

When the proportion is less than 30%, the development of crimp under restraint in a twisted state becomes poor. On the other hand, when the proportion exceeds 70%, hands such as softness and puffiness become poor. The fineness of the single filament of the conjugate multifilament yarn is preferably 2 to 10 denier. When the fineness is less than 2 denier, no sufficient crimping occurs. On the other hand, when the fineness exceeds 10 denier, the hand of the woven fabric becomes hard.

The fineness of the single filament of the multifilament yarn constituting the major component of the outer layer is preferably 0.01 to 3 denier from the viewpoint of contribution mainly to the hand of the woven fabric. The fineness of the single filament of the conjugate multifilament yarn is preferably equal to or larger than the fineness of the single filament of the multifilament yarn of the outer layer. The difference in the fineness of the single filament between both multifilament yarns is preferably 10 denier or less, still preferably in the range of from 1 to 6 denier.

The conjugate multifilament yarn used in the present invention is a yarn produced by conjugating in parallel two kinds of polyester polymers different from each other in the heat shrinkability, or conducting conjugation in such a manner that the core component is eccentrically disposed in the sheath component. This conjugate multifilament yarn is a yarn which develops three-dimensional crimping in a spiral form by heat-treatment after a spinning and a drawing steps. It is possible to further increase the crimped rigidity and the textured rigidity through the false twisting of the conjugate multifilament yarn.

The two kinds of polyester polymers different from each other in the heat shrinkability are preferably that one of them is a low-viscosity polyester while the other is a high-viscosity polyester. The intrinsic viscosity of the low-viscosity polyester is preferably in the range of from 0.43 to 0.55, while the intrinsic viscosity of the high-viscosity polyester is preferably in the range of from 0.68 to 0.85. When the intrinsic viscosity of the low-viscosity polyester is less than 0.43, the development of crimp in the conjugate multifilament yarn becomes so poor that it becomes difficult to attain the stretching property of the composite crimped yarn in a twisted state. When the intrinsic viscosity of the high-viscosity polymer exceeds 0.85, the melt viscosity becomes so high that a conjugate spinning becomes difficult. The difference in the intrinsic viscosity between the low-viscosity polyester and the high-viscosity polymer is preferably in the range of from 0.20 to 0.40. When the difference in the intrinsic viscosity is less than 0.20, the development of crimp of the conjugate multifilament yarn becomes so poor that it becomes difficult for the conjugate multifilament yarn to exhibit the stretching property in the form of a composite crimped yarn. When the difference in the intrinsic viscosity exceeds 0.40, a large deflection occurs when a conjugate yarn is delivered from a spinneret, so that the spinning becomes very unstable.

In this case, the intrinsic viscosity, IV, is determined by dissolving 0.8 g of a polyester sample in 10 ml of o-chlorophenol at 25° C., determining the relative viscosity, $\eta r$, according to the following equation (4) through the use of an Ostwald viscometer and calculating the intrinsic viscosity from the relative viscosity, $\eta r$, according to the following equation (5):

$$\eta r=(\eta/\eta\emptyset)-(t\cdot d/r\emptyset\cdot d\emptyset) \quad (4)$$

$$IV=0.0243\eta r+0.2634 \quad (5)$$

wherein:

$\eta$: solution viscosity of polyester, $\eta\emptyset$: viscosity of solvent, t: dropping time of solution (sec), d: density of solution (g/cm$^3$), $t\emptyset$: dropping time of o-chlorophenol (sec), and $d\emptyset$: density of o-chlorophenol (g/cm$^3$).

Further, the conjugation ratio of the low-viscosity polyester to the high-viscosity polyester in the conjugate multifilament yarn is preferably in the range of from 40:60 to 60:40 in terms of the weight ratio. If the ratio is outside the above-described range, the textured rigidity, TR, decreases with an increasing number of the twists in the subsequent twisting when the crimped conjugate multifilament yarn is subjected to false twisting together with the crimped multifilament yarn of a single polymer. This tendency is significant when the difference in the yarn length between the crimped conjugate multifilament yarn and the other crimped multifilament yarn, that is, $\Delta L$, becomes large.

The polyester polymer having a different heat shrinkability preferably comprises polyethylene terephthalate alone or a copolyester containing 80% by mole of polyethylene terephthalate. Examples of the copolymer component of the copolyester include known components such as isophthalic acid, isophthalic acid having a metal sulfonate group, a bisphenol, neopentyl glycol or 1,6-cyclohexanediol. Known compounds such as delustering agents, ultraviolet absorbers and stainproofing agents may be added to these polyester polymers in such an amount as will not inhibit the effect of the present invention.

Figure 3:
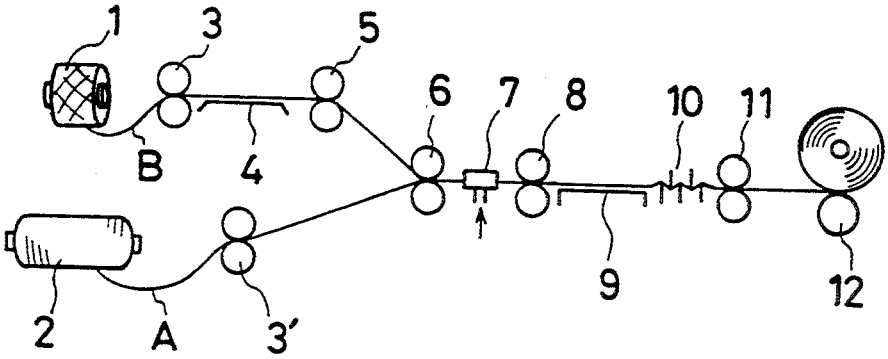
FIG. 3 is a process diagram showing one embodiment of the process for producing the composite crimped yarn of the present invention.
Figure 4:
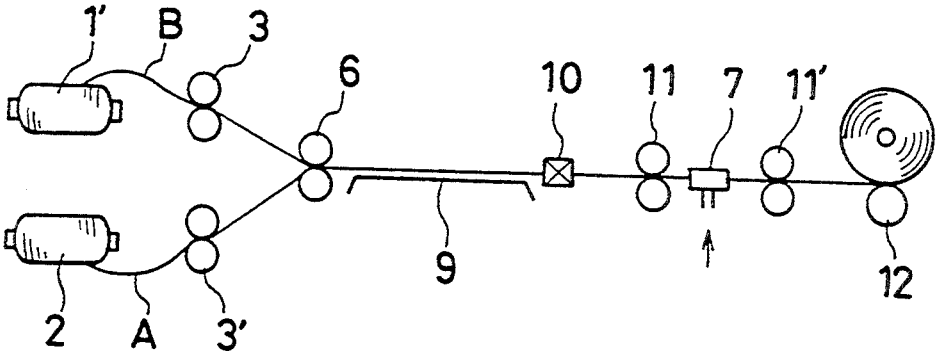
FIG. 4 is a process diagram showing another embodiment of the process for producing the composite crimped yarn of the present invention.

In the production of the above-described composite crimped yarn according to the present invention, it is possible to use a composite false twisting method shown in FIGS. 3 and 4. Examples of the composite false twisting method include a method wherein a feed difference is provided between at least two kinds of untwisted multifilament yarns, which are simultaneously subjected to false twisting, and a method wherein at least two kinds of untwisted multifilament yarns different from each other in the elongation are simultaneously subjected to false twisting. In the feed difference composite false twisting method, it is preferred to feed an untwisted multifilament yarn of a single polymer to an untwisted conjugate multifilament yarn in a percentage overfeed of about 15%.

In the elongation difference composite false twisting method, an untwisted conjugate multifilament yarn and an untwisted multifilament yarn of a single polymer having an elongation of 55% or less higher than that of the untwisted conjugate multifilament yarn are doubled and subjected to composite false twisting. Thus, when the elongation difference is suppressed to 55% or less, the untwisted conjugate multifilament yarn and the untwisted multifilament yarn of a single polymer component can be partially migrated to each other to form a composite crimped yarn wherein the core portion is not clearly separated from the sheath portion. In a combination of untwisted multifilament yarns having an elongation difference of 55% or more, the composite false twisting is preferably conducted after the elongation difference is reduced to 55% or less through previous heat drawing step before the untwisted multifilament yarn having a higher elongation is fed in a false twisting zone. When the elongation difference between the untwisted multifilament yarns is 40% or less, the degree of the mutual migration between the conjugate multifilament and the multifilament of a single component in the composite crimped yarn after the composite false twisting can be made large. If a thick and thin yarn is used for the untwisted multifilament yarn, the degree of the mutual migration is more largely developed.

In the false twisting apparatus, it is possible to use a spindle system when a composite crimped yarn having a small yarn length difference between both multifilament yarns is to be prepared. However, when a composite crimped yarn having a large yarn length difference is to be produced, it is possible to use a friction system. Even in the production of a composite crimped yarn having a large difference in the yarn length, it is possible to use the spindle system when the false twisting is conducted with a large number of twists through previous interlacing of both of the untwisted multifilament yarns with each other.

FIG. 3 is a diagram, showing the steps of the production of the composite crimped yarn according to the present invention by the elongation difference composite false twisting method.

In FIG. 1, the numeral 1 refers to a package comprising a wound untwisted multifilament yarn B of a single polymer component having a relatively high elongation produced according to the high speed spinning method, while the numeral 2 refers to a package comprising a wound untwisted conjugate multifilament yarn A comprising polyester polymers different from each other in the heat shrinkability.

The untwisted multifilament yarn B is previously heat drawn at a low draw ratio between the rollers 3 and 5 and, at the same time, heat-treated by means of a heater 4 so that it becomes a thick and thin yarn having a difference of 55% or less in the elongation with the untwisted conjugate multifilament yarn A, and then doubled by means of a roller 6 together with the untwisted conjugate multifilament yarn A fed from a feed roller 3'. Then, the untwisted multifilament yarns A and B are interlaced with each other by means of an interlacing nozzle 7 provided between the rollers 6 and 8 by means of compressed air, false twisting is conducted by means of a false twisting heater 9 and a false twisting spindle 10 provided between the rollers 8 and 11, and taken up in the form of a composite crimped yarn by means of a take-up device 12. The untwisted multifilament yarn B having a high elongation is elongated in a false twisting zone between the roller 8 and 11 to give a yarn length difference between the untwisted multifilament yarn B having a high elongation and the untwisted conjugate multifilament yarn A having a low elongation, thus producing a composite crimped yarn as shown in FIG. 1.

FIG. 4 is a diagram showing the steps of the production of the composite crimped yarn of the present invention by the feed difference composite false twisting method or the elongation difference composite false twisting method which needs no heat drawing prior to the false twisting.

In FIG. 4, when the feed difference composite false twisting method is used, the untwisted multifilament yarn B in the package 1' and the untwisted conjugate multifilament yarn A in the package 2 are doubled with each other by means of a roller 6 while feeding the former untwisted yarn B in a larger amount than the latter untwisted yarn A respectively from feed rollers 3 and 3'. Then, stretching and false twisting are simultaneously conducted by means of the false twisting heater 9 and the false twisting spindle 10 provided between the rollers 6 and 11 to give a composite crimped yarn which is then interlaced by means of an interlacing nozzle 7 provided between the rollers 11 and 11' and taken up by means of a take-up device 12. In the elongation difference composite false twisting method, the untwisted yarns A and B are fed respectively from the feed rollers 3 and 3' in a false twisting zone at an identical feed rate and then subjected to the same false twisting as that described above.

On the other hand, in the above-described woven fabric according to the present invention, a further new effect can be imparted when the crimped multifilament yarn B in the composite crimped yarn is formed so as to have a special construction and a weight reduction treatment with an alkali is conducted in the step of dyeing.

For example, when use is made of a multifilament yarn in the thick and thin form comprising a polyester polymer as the crimped multifilament yarn B, fuzzing occurs in the thick and thin multifilament yarn through a weight reduction treatment with an alkali in the step of dyeing, the resultant woven fabric can have a hand similar to that of the spun fabric. In the composite crimped yarn within a woven fabric after a weight reduction treatment with an alkali, the twist is in the range of 6,700 to 18,000 in terms of the twist coefficient, $\alpha$, through the weight reduction treatment with an alkali. This woven fabric still has a stretching property of 3 to 20%. in terms of the stretchability and a drapability.

In the composite crimped yarn for producing such a woven fabric similar to a spun fabric, a partially-drawn yarn may be used as an untwisted thick and thin multifilament yarn B, and in the composite false twisting method comprising the steps shown in FIG. 3, it is drawn before false twisting so as to have the Uster unevenness, U % value, of 2 to 20% and false twisted so as to have a U % value of 1.4 to 5%. after the drawing. When a previously drawn yarn is used as the untwisted thick and thin multifilament yarn B, the same treatment can be conducted by the feed difference composite false twisting method shown in FIG. 4.

In another method, similarly, a woven fabric similar to a spun fabric can be prepared even when use is made of two kinds of mixed multifilament yarns as the untwisted multifilament yarn B which comprises a partially-drawn yarn of a regular polyester multifilament yarn and a partially-drawn cation dyeable polyester multifilament yarn different from each other in the elongation. The mixed multifilament yarns are previously heat-drawn according to the step shown in FIG. 3 and subjected to composite false twisting together with the conjugate multifilament yarn A to give a composite crimped yarn. As described above, the composite crimped yarn is previously twisted and then woven, and the resultant woven fabric is subjected to a weight reduction treatment (surface dissolution treatment) with an alkali in the step of dyeing. In the woven fabric subjected to a weight reduction treatment with an alkali, fuzzing occurs in the cation dyeable polyester multifilament yarn within the composite crimped yarn to form a structure wherein a lot of fuzzes exist in the inner layer and the outer layer of the composite crimped yarn, Therefore, the woven fabric has a hand like that of a spun fabric having suitable fuzzes.

The twist of the composite crimped yarn constituting the woven fabric is 6,700 to 18,000 in terms of the twist coefficient, if. It is a matter of course that the woven fabric has a stretchability of 3 to 25% inherent in the composite crimped yarn and a drapability.

As described above, when the composite crimped yarn of the present invention having the above-described construction is twisted and woven into a fabric, the woven fabric has a puffiness and suitable hari and koshi and an excellent drapability and, at the same time, a suitable stretching property. Therefore, no puckering occurs during sewing, and the sewing can be conducted with a good tailorability and good comfortability in wearing can be attained.

EXAMPLE 1

An undrawn conjugate multifilament yarn comprising a low-viscosity component consisting of 100% of a polyethylene terephthalate having an intrinsic viscosity of 0.475 and a high-viscosity component consisting of 100% of a polyethylene terephthalate having an intrinsic viscosity of 0.780 laminated in parallel in a conjugation ratio of 50:50 by weight was melt-spun and drawn to give a conjugate multifilament yarn of 75D–18F. The undrawn yarn had a strength of 3.2 g/d, an elongation of 41% and a shrinkage in boiling water of 4.8%.

Separately, 100% of a polyethylene terephthalate was melt-spun at a spinning rate of 2,800 m/min to produce a partially-drawn multifilament yarn of 80D–48F having an elongation of 165%.

A composite crimped yarn was produced by the elongation difference composite false twisting method shown in FIG. 3 through the use of the above-described conjugate multifilament yarn and partially-drawn multifilament yarn. In the elongation difference composite false twisting method, the partially-drawn multifilament yarn was drawn at a draw ratio of 1.4 and a temperature of 170° C. before being fed into the false twisting zone so as to give a thick and thin yarn having an elongation of 91% with a difference of 50% relative to the partially-drawn multifilament yarn. The thick and thin yarn had a birefringence of $30\times10^{-3}$ in a thick portion and a birefringence of $90\times10^{-3}$ in a thin portion. Further, after both of the multifilament yarns were doubled and interlaced with each other through the use of an interlacing nozzle having a size of 0.8 mm$\phi\times2$ holes by means of an air pressure of 4 kg/cm$^2$. Then, flase twisting was conducted by a conventional friction system under the conditions of a number of twists of 2,350 turns/m, a temperature of 185° C. and a feed rate of +1% (overfeed).

The resultant composite crimped yarn had such a construction that the conjugate multifilament yarn is mainly arranged as the inner layer and part of the multifilament yarn constituting the outer layer is migrated thereto. Further, the composite crimped yarn had fineness of 134 denier and a strength of 2.4 g/denier, and the stretching property in a non-twisted state was 32.8% in terms of the crimped rigidity, CR, and 19.9% in terms of the textured rigidity, TR.

Subsequently, the composite crimped yarn was twisted in 1,000 turns/m (twist coefficient, $\alpha$: 11,619) in the S-direction at 8,000 r.p.m. on a double twister to give a twisted yarn having a fineness of 140 denier and a strength of 2.3 g/denier. This twisted yarn had a yarn length difference, $\Delta L$, between the conjugate multifilament yarn constituting the inner layer and the multifilament yarn constituting the outer layer of 28%, and an excellent stretching properties such as a crimped rigidity, CR, of 26.7% and a textured rigidity, TR, of 13.3%, which were very low in reduction in the crimped rigidity and the textured rigidity as compared with those in a non-twisted state.

Then, the above twisted yarn was used as a warp yarn and a weft yarn, and woven into a plain weave fabric having a gray density of 86 yarns/25.4 mm$\times$64 yarns/25.4 mm through the conventional weaving process. The plain weave fabric was subjected to a crimp development treatment in the step of dyeing to give a woven fabric having a density of 102 yarns/25.4 mm$\times$82 yarns/25.4 mm. The resultant woven fabric had puffiness and hari and koshi and, at the same time, an excellent drapability and an excellent stretching property of 15%$\times$13% to the warp and weft directions, respectively, in terms of the stretchability. Further, when sewing was conducted, no puckering occurred, so that a very excellent tailorability in sewing was obtained.

COMPARATIVE EXAMPLE 1

Composite false twisting was conducted in the same manner as that of Example 1, except that a drawn yarn comprising 100% of a polyethylene phthalate of 75D–18F (strength: 5.2 g/d, elongation: 43%) was used instead of the conjugate multifilament yarn, thereby preparing a composite crimped yarn having a fineness of 138 denier and a strength of 3.2 g/denier. The stretching property of the composite crimped yarn in a non-twisted state was 24.6% in terms of the crimped rigidity, CR, and 5.0% in terms of the textured rigidity, TR.

Subsequently, the composite crimped yarn was twisted in the same manner as that of Example 1 to give a twisted yarn having a fineness of 144 denier and a strength of 3.1 g/denier. The crimped rigidity, CR, and the textured rigidity, TR, of the twisted yarn were 13.0% and 2.0%, respectively, which were much lower than those in the non-twisted state, and the stretching property was remarkably inferior.

Then, the twisted yarn was woven into a fabric in the same manner as that of Example 1 and subjected to a crimp development treatment in the step of dyeing. As a result, the density was 92 yarns/25.4 mm$\times$67 yarns/25.4 mm, and the stretchability was 0%$\times$0% to the warp and weft directions, that is, the product had no stretching property at all. For this reason, puckering occurred in sewing, and the tailorability was so poor as to produce a poor appearance.

COMPARATIVE EXAMPLE 2

Same conjugate multifilament yarn and partially drawn multifilament yarn as those used in Example 1 were false twisted to give a composite crimped yarn under the same conditions as in Example 1 except that the partially-drawn multifilament yarn was not heat-drawn before false twisting and that the feed rate was changed to −4% (underfeed). The resultant composite crimped yarn had a structure such that the crimped conjugate multifilament yarn was in a more stretched state than that of Example 1 and was wrapped around with the crimped multifilament yarn in an alternately twisted state, and also the composite crimped yarn had comparatively many untwisted portions in it. The composite crimped yarn had a fineness of 146.6 denier, a strength of 1.48 g/d, an elongation of 22.1%, and a stretching property of 22.5% for the crimped rigidity, CR, and 12.3% for the textured rigidity, TR, in a non-twisted state.

Then, the composite crimped yarn was twisted in 1,000 turns/m (twist coefficient, $\alpha$, of 11,619) by being rewound under the same condition as in Example 1. However, the yarn tension was set at a little lower value since there occurred a lot of yarn breakage during rewinding operation. The resultant twisted yarn had a fineness of 153.7 denier, a strength of 1.56 g/d, an elongation of 21.4%, a yarn length difference, $\Delta L$, of 32%, a crimped rigidity, CR, of 11.3% and a textured rigidity, TR, of 5.9%. The twisted yarn had such a poor strength that it could not be woven to a fabric.

EXAMPLE 2

The conjugate multifilament yarn of 75D–18F produced in Example 1 and a drawn multifilament yarn of 50D–72F (strength: 5.3 g/d) comprising 100% of polyethylene terephthalate produced by the conventional method were subjected to composite false twisting through the use of a spindle false twisting device shown in FIG. 4 to give a composite crimped yarn. The false twisting was conducted under the conditions of the number of revolutions of the spindle of 250,000 r.p.m., the number of twist of 2,300 turns/m, a temperature of 185° C. and a feed rate of −2% (underfeed) on the side of the conjugate multifilament yarn and +5% (overfeed) on the side of the drawn multifilament yarn.

In a non-twisted state, the resultant composite crimped yarn had a fineness of 129 denier, a strength of 3.6 g/d, a crimped rigidity, CR, of 30.7%, a textured rigidity, TR, of 20.0% and a yarn length difference, $\Delta L$, of 7%.

Then, the composite crimped yarn was twisted on a double twister in the number of twists of 600 turns/m (twist coefficient, $\alpha$, of 6810) and 1,000 turns/m (twist coefficient, $\alpha$, of 11,350) to give two kinds of twisted yarns. Regarding the properties of individual twisted yarns, the former had a fineness of 130 denier, a crimped rigidity, CR, of 30.6% and a textured rigidity, TR, of 12.2%, and the latter had a fineness of 134 denier, a crimped rigidity, CR, of 20.8% and a textured rigidity, TR, of 7.4%, that is, both of the composite crimped yarns had an excellent stretching property.

COMPARATIVE EXAMPLE 3

A composite crimped yarn was produced through composite false twisting in the same manner as in Example 2, except that a drawn multifilament yarn of 75D–18F comprising 100% of a polyethylene terephthalate produced by the conventional method was used instead of the conjugate multifilament yarn and the percentage feed of the drawn multifilament yarn of 75SD–18F was 0%.

In a non-twisted state, the resultant composite crimped yarn had a crimped fineness of 130 denier, a crimped rigidity, CR, of 28.3% and a textured rigidity, TR, of 10.5%. Then, the composite crimped yarn was twisted on a double twister in the number of twists of 600 turns/m and 1,000 turns/m in the same manner as in Example 2 to give two kinds of twisted yarns. Regarding the properties of individual twisted yarns, the former had a fineness of 135 denier, a crimped rigidity, CR, of 8.6% and a textured rigidity, TR, of 1.3%, and the latter had a fineness of 138 denier, a crimped rigidity, CR, of 2.4% and a textured rigidity, TR, of 0.5%, that is, both of the composite crimped yarns were poor in the crimp developing power as well as in the stretching property.

EXAMPLE 3

False twisting was conducted by the steps of composite false twisting shown in FIG. 3 through the use of a conjugate multifilament yarn of 75D–18F produced in Example 1 and a partially-drawn polyester multifilament yarn of 80D–48F. In this case, in the step of drawing before the false twisting zone, the partially-drawn polyester multifilament yarn of 80D–48F was drawn at a draw ratio of 1.4 with a hot pin of 75° C. to give a thick and thin yarn having a birefringence of $40\times10^{-3}$ in the thick portion and a birefringence of $100\times10^{-3}$ in the thin portion, and an elongation of 78% with a difference of 37% from that of the conjugate multifilament yarn. The partially-drawn multifilament yarn was then doubled together with the conjugate multifilament yarn of 75D–18F and subjected to false twisting in a false twisting zone under the conditions of the number of twists of 2,350 turns/m, a temperature of 185° C. and a feed percentage of +1% (overfeed).

The resultant composite crimped yarn had a fineness of 144.6 denier, a strength of 2.7 g/d, a crimped rigidity, CR, of 34.0%, a textured rigidity, TR, of 18.55 and a yarn length difference, $\Delta L$, of 13%.

Subsequently, the composite crimped yarn was twisted in 1,000 turns/m (twist coefficient, $\alpha$, of 12,020) in the S-direction at 8,000 r.p.m. on a double twister to give a twisted yarn. The twisted yarn had a fineness of 147 denier, a strength of 2.8 g/d, a crimped rigidity, CR, of 23.5% and a textured rigidity, TR, of 9.1%.

Then, this twisted yarn was used as both a warp yarn and a weft yarn, and a plain weave fabric having a gray density of 86 yarns/25.4 mm×64 yarns/25.4 mm to the warp and weft directions, respectively, was prepared through the conventional tional weaving process. Then, in the step of dyeing a relaxing treatment was conducted at 98° C., and an intermediate setting was conducted at 180° C. Thereafter, a treatment with an alkaline solution for attaining a weight reduction of 28% was conducted. The treated plain weave fabric was washed with water and dyed at 130° C. The dyed woven fabric had a density of 102 yarns/25.4 mm×82 yarns/25.4 mm, was a woven fabric having fuzzes on the surface thereof similar to a spun fabric, and had a stretching property of 15%×13% to the warp and weft directions, respectively, in terms of the stretchability.

EXAMPLE 4

The same conjugate multifilament yarn of 75D–18F as that used in Example 1 and a partially-drawn multifilament yarn of an atmospheric cation dyable polyester of 85D–24F having an elongation of 131% produced by high-speed spinning at 3,000 m/min were doubled to give a multifilament yarn which was used as an untwisted multifilament yarn A shown in FIG. 3. Separately, the same partially-drawn yarn of a polyester of 80D–48F as that used in Example 1 was previously heat-drawn at a draw ratio of 1.4 to give a thick and thin yarn, which was used as an untwisted multifilament yarn B. Both the multifilament yarns A and B were doubled and interlaced with each other by means of an interlacing nozzle, and simultaneous false twisting was conducted in a false twisting zone to give a composite crimped yarn of 216 D.

Subsequently, the composite crimped yarn was twisted in 800 turns/m (twist coefficient, $\alpha$, of 11,750) in the S-direction to give a twisted yarn having a fineness of 220 denier, a strength of 2.1 g/d, a crimped rigidity, CR, of 26.2%, a textured rigidity, TR, of 9.3 and a yarn length difference, ΔL, of 30%. Then, the resultant twisted yarn was used as both of a warp yarn and a weft yarn to be woven into a 2/2 twill weave fabric through a conventional weaving process. The gray woven fabric was dyed and finished under the conventional dyeing conditions. In this case, the woven fabric was treated with an alkali solution for a 15% weight reduction.

In the resultant woven fabric, a fuzz occurring from the inner layer of the composite crimped yarn and a fuzz originating from the outer layer appeared as a mixture on the surface thereof, and the appearance was like that of a spun fabric. The woven fabric had a hand having puffiness, an excellent drapability, and an excellent stretching property of a stretchability of 12%×11% to the warp and weft directions, respectively.

What is claimed is:

1. A woven fabric comprising: a warp yarn and a weft yarn, at least one of the warp yarn and the weft yarn being a composite crimped yarn, said composite crimped yarn comprising at least two kinds of multifilament yarns, one of the multifilament yarns being comprised of a crimped conjugate multifilament yarn comprising two kinds of polyester polymers different from each other in the heat shrinkability and positioned as a major component of the inner layer of said composite crimped yarn, the other of them being comprised of a crimped multifilament yarn of a single synthetic polymer having a yarn length 5 to 35% larger than that of said crimped conjugate multifilament yarn and positioned as a major component in the outer layer of said composite crimped yarn, part of said crimped multifilament yarn being migrated to said crimped conjugate multifilament yarn disposed in the inner layer and part of said crimped conjugate multifilament yarn being migrated to said crimped multifilament yarn disposed in the outer layer, said composite crimped yarn being twisted to such an extent that atwist coefficient, $\alpha$, defined by the equation: $\alpha = T\sqrt{D}$ wherein T is the number of twists (turns/meter) and D is the total fineness (denier) is 7,100 to 21,300, a stretchability of said woven fabric in the yarn direction of said at least one of the warp yarn and weft yarn being 3 to 25%.

2. A woven fabric according to claim 1, wherein said crimped composite multifilament yarn accounts for 30 to 70% by weight of the whole of said composite crimped yarn.

3. A woven fabric according to claim 1, wherein the single filament fineness of said crimped conjugate multifilament yarn is in the range of from 2 to 10 denier and the single filament fineness of said crimped multifilament yarn is in the range of from 0.01 to 3 denier.

4. A woven fabric according to claim 1, wherein the single filament finess of said crimped conjugate multifilament yarn is equal to or higher than that of said crimped multifilament yarn and is 10 deiner or less.

5. A woven fabric according to claim 1, wherein said crimped conjugate multifilament yarn comprises said two kinds of polyester polymers laminated in parallel with each other.

6. A woven fabric according to claim 1, wherein said crimped conjugate multifilament yarn comprises a sheath component comprised of one of said two kinds of polyester polymers and a core component comprised of the other polyester polymer, said core component being eccentrically disposed in the sheath component.

7. A woven fabric according to claim 1, wherein one of the two kinds of polyester polymers of said crimped conjugate multifilament yarn is a low-viscosity polyester polymer and the other polyester polymer is a high-viscosity polyester polymer.

8. A woven fabric according to claim 1, wherein a synthetic polymer constituting said crimped multifilament yarn is one selected from the group consisting of polyesters and nylons.

9. A woven fabric according to claim 1, wherein twisting is applied to said composite crimped yarn to such an extent that the twist coefficient, $\alpha$, is in the range of from 6,700 to 18,000, a synthetic polymer constituting said crimped multifilament yarn is a cation dyeable polyester and said crimped multifilament yarn has many fuzzes on the surface thereof.

10. A woven fabric according to claim 1, wherein twisting is applied to said composite crimped yarn to such an extent that the twist coefficient, $\alpha$, is in the range of from 6,700 to 18,000, and said crimped multifilament yarn comprises thick and thin polyester filaments and has many fuzzes on the surface thereof.

* * * * *